US005123774A

United States Patent [19]

Dubiel

[11] Patent Number: 5,123,774

[45] Date of Patent: Jun. 23, 1992

[54] TIRE PUNCTURING APPARATUS

[76] Inventor: John J. Dubiel, P.O. Box 248, Dalhart, Tex. 79022

[21] Appl. No.: 779,329

[22] Filed: Oct. 18, 1991

[51] Int. Cl.[5] ..... E01F 13/00; E01F 15/00

[52] U.S. Cl. ..... 404/6

[58] Field of Search ..... 30/166.3, 366; 404/6; 49/9, 34

[56] References Cited

U.S. PATENT DOCUMENTS 4,382,714 5/1983 Hutchison ..... 404/6

*Primary Examiner*—Douglas D. Watts
*Attorney, Agent, or Firm*—Hugh E. Smith

[57] ABSTRACT

An apparatus wherein a plurality of spaced tubular supports are secured together by a flexible tether line, wherein respective outer distal tubular support members include a respective outer tether line that in turn is secured to a respective spike member for projection into ground surface on opposed sides of a highway structure. Plural pairs of spaced parallel spikes defining an acute angle therebetween, wherein intermediately spaced pairs of piercing spikes is a third spike bisecting an obtuse included angle defined by the first and second spike members of each spike pair, wherein the first, second, and third spike members define an acute angle of approximately 120 degrees therebetween.

1 Claim, 4 Drawing Sheets

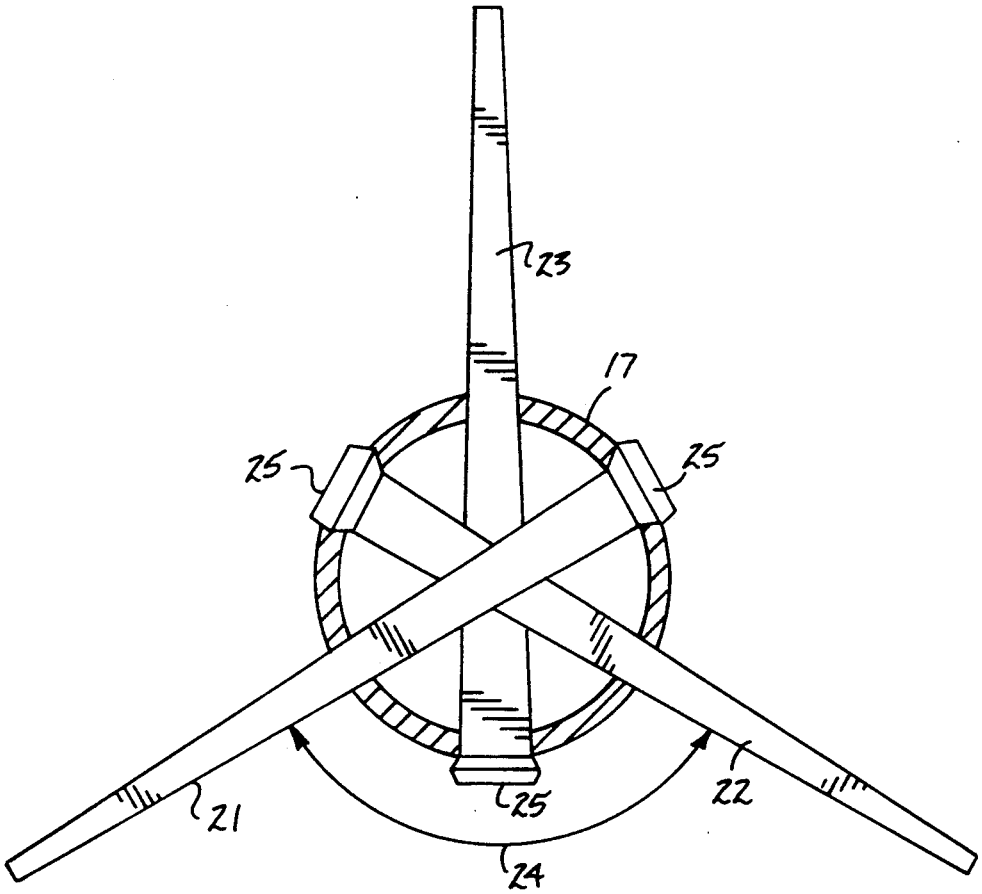
FIG 6
FIG 7
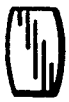
FIG 8
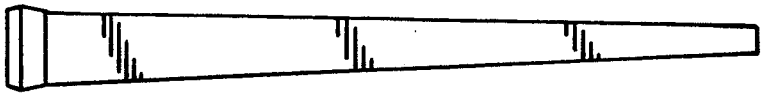
FIG 9
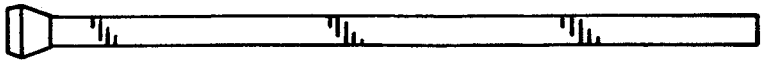

TIRE PUNCTURING APPARATUS

BACKGROUND OF THE INVENTION

1. Field of the Invention

The field of invention relates to tire piercing apparatus, and more particularly pertains to a new and improved tire puncturing apparatus wherein the same is arranged to arrest unauthorized or vehicles under pursuit from further travel along a highway organization.

2. Description of the Prior Art

Various road barriers and tire piercing structure has been utilized in the prior art to prevent vehicle access along a highway such as is typified during pursuit of runaway vehicles. Prior art tire piercing apparatus is exemplified in U.S. Pat. No. 4,473,948 to Chadwick wherein a base plate includes a plurality of pins projecting upwardly of the base plate to prevent an automobile from being driven.

U.S. Pat. No. 4,879,554 to Silveira sets forth a barrier for parking spaces utilizing a plate with an indicator sign that is extended to indicate a reserved parking area.

As such, it may be appreciated that there continues to be a need for a new and improved tire puncturing apparatus as set forth by the instant invention which addresses both the problems of ease of use as well as effectiveness in construction for use primarily by law enforcement personnel effecting the piercing of tires of a vehicle under pursuit and in this respect, the present invention substantially fulfills this need.

SUMMARY OF THE INVENTION

In view of the foregoing disadvantages inherent in the known types of tire puncturing apparatus now present in the prior art, the present invention provides a tire puncturing apparatus wherein the same is arranged as a plurality of tubular support members, each including a matrix of tire puncturing spikes mounted therein. As such, the general purpose of the present invention, which will be described subsequently in greater detail, is to provide a new and improved tire puncturing apparatus which has all the advantages of the prior art tire puncturing apparatus and none of the disadvantages.

To attain this, the present invention provides an apparatus wherein a plurality of spaced tubular supports are secured together by a flexible tether line, wherein respective outer distal tubular support members include a respective outer tether line that in turn is secured to a respective spike member for projection into ground surface on opposed sides of a highway structure. Plural pairs of spaced parallel spikes definning an acute angle therebetween, wherein intermedially spaced pairs of piercing spikes is a third spike bisecting an obtuse included angle defined by the first and second spike members of each spike pair, wherein the first, second, and third spike members define an acute angle of approximately 120 degrees therebetween.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tire puncturing apparatus which has all the advantages of the prior art tire puncturing apparatus and none of the disadvantages.

It is another object of the present invention to provide a new and improved tire puncturing apparatus which may be easily and efficiently manufactured and marketed.

It is a further object of the present invention to provide a new and improved tire puncturing apparatus which is of a durable and reliable construction.

An even further object of the present invention is to provide a new and improved tire puncturing apparatus which is susceptible of a low cost of manufacture with regard to both materials and labor, and which accordingly is then susceptible of low prices of sale to the consuming public, thereby making such tire puncturing apparatus economically available to the buying public.

Still yet another object of the present invention is to provide a new and improved tire puncturing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an orthographic top view of an individual piercing spike utilized by the invention.

FIG. 8 is an orthographic top view of an individual piercing spike.

FIG. 9 is an orthographic side view of the piercing spike as set forth in FIGS. 7 and 8.

FIG. 10 is an isometric illustration of the instant invention in use.

DESCRIPTION OF THE PREFERRED EMBODIMENT

Figure 1:
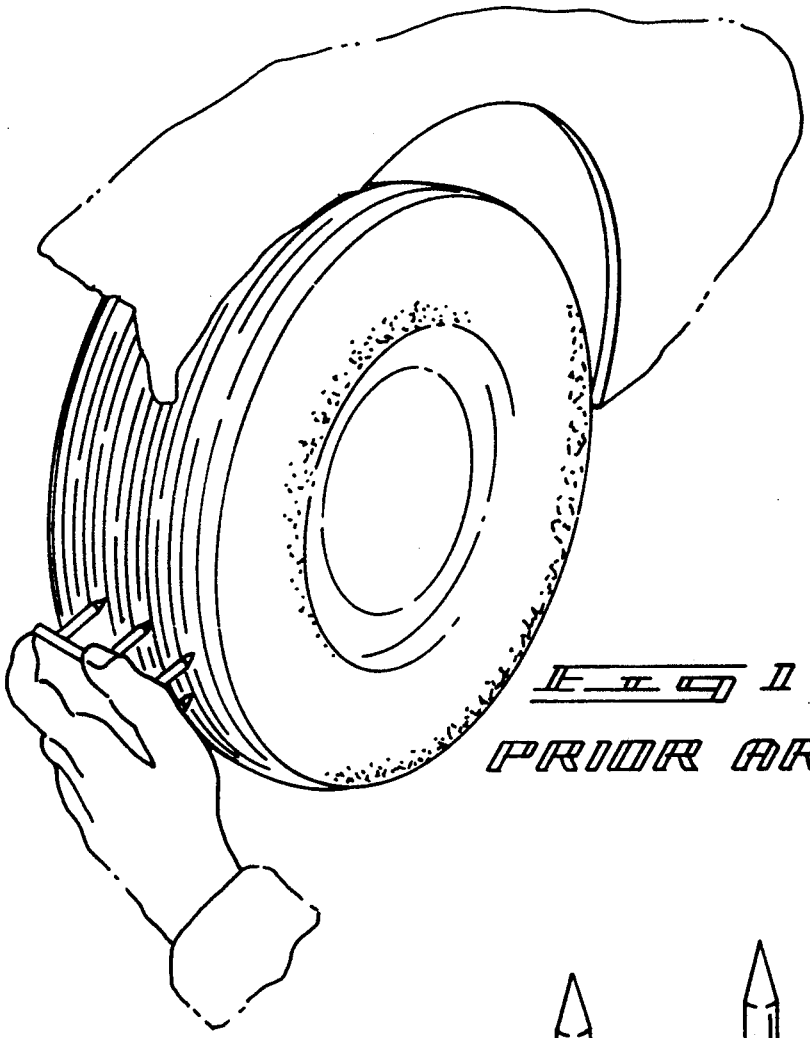
FIG 1 PRIOR ART
FIG. 1 is an isometric illustration of a prior art tire puncturing apparatus in use.
Figure 2:
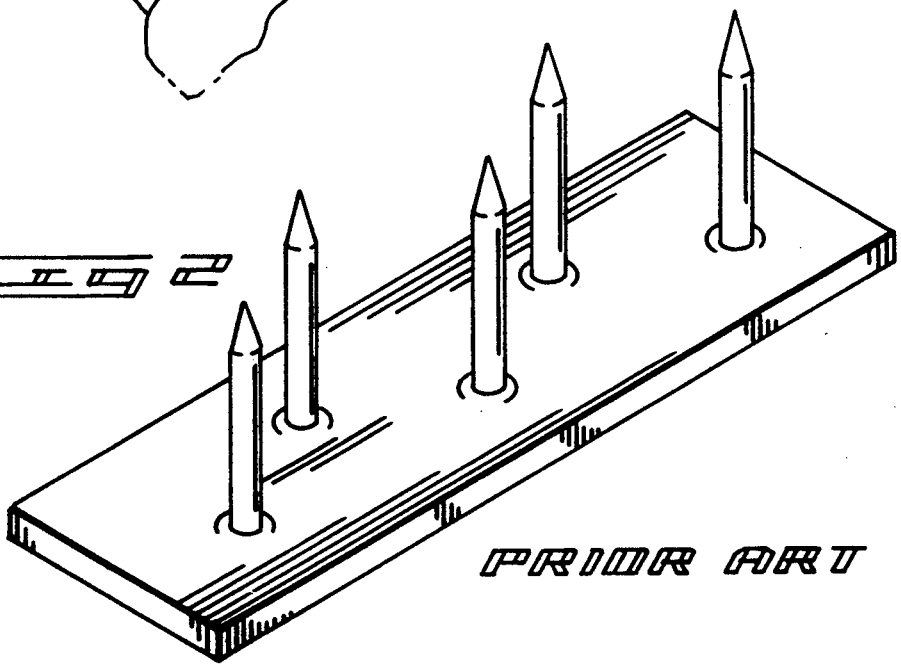
FIG 2 PRIOR ART
FIG. 2 is an isometric illustration of the prior art puncturing apparatus as illustrated in FIG. 1.

With reference now to the drawings, and in particular to FIGS. 1 to 10 thereof, a new and improved tire puncturing apparatus embodying the principles and concepts of the present invention and generally designated by the reference numeral 10 will be described.

FIG. 1 illustrates a prior art tire puncturing device for use by law enforcement officers, as set forth in U.S. Pat. No. 4,473,948 utilizing a plurality of pins mounted upon a base plate in a generally parallel relationship relative to one another in a staggered array.

More specifically, the tire puncturing apparatus 10 of the instant invention essentially comprises a plurality of piercer assemblies 11 secured together by intermediate flexible tether lines 14, wherein a respective first and second mounting spike tether line 15 and 16 extend exteriorly of the outer distal piercer assemblies 11, wherein the first and second mounting tether lines 14 and 15 mount their interior ends to a respective outermost piercer assembly 11 and are secured to respective first and second mounting spikes 12 and 13 at remote ends of each of the first and second mounting spike tether lines 15 and 16 respectively, wherein each of the mounting spikes are formed with an elongate shank formed with a lower point end and an upper loop to receive a tether line thereon to permit the securement and spanning of the apparatus 10 relative to a highway 26, such as typified in the FIG. 10.

Figures 3, 4, 5, 6:
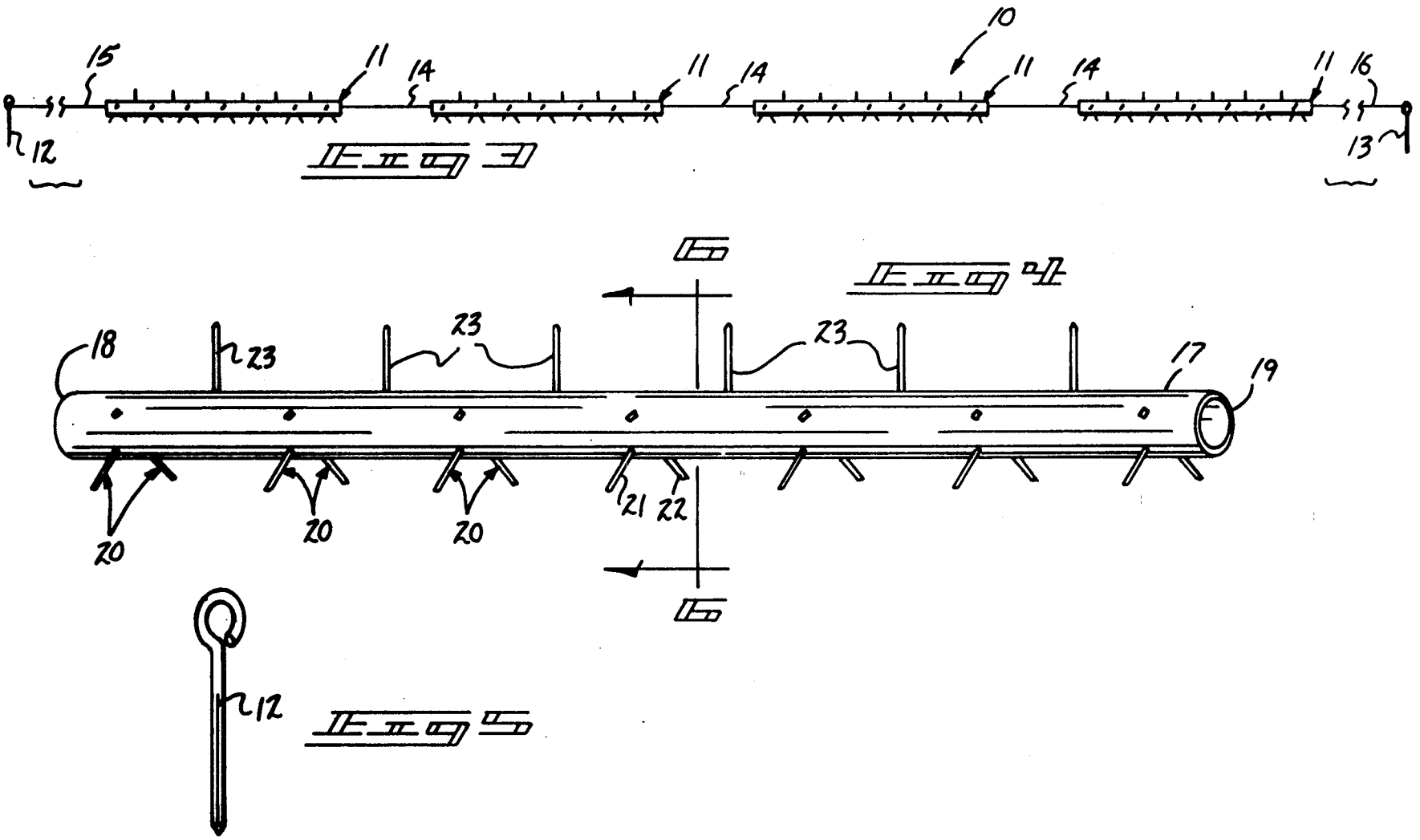
FIG. 3 is an orthographic view of the instant invention.
FIG. 4 is an isometric illustration of an individual support tube in an associated spike matrix.
FIG. 5 is an orthographic view of an individual mounting spike utilized by the invention.
FIG. 6 is an orthographic view, taken along the lines 6—6 of FIG. 4 in the direction indicated by the arrows.
Figure 11:
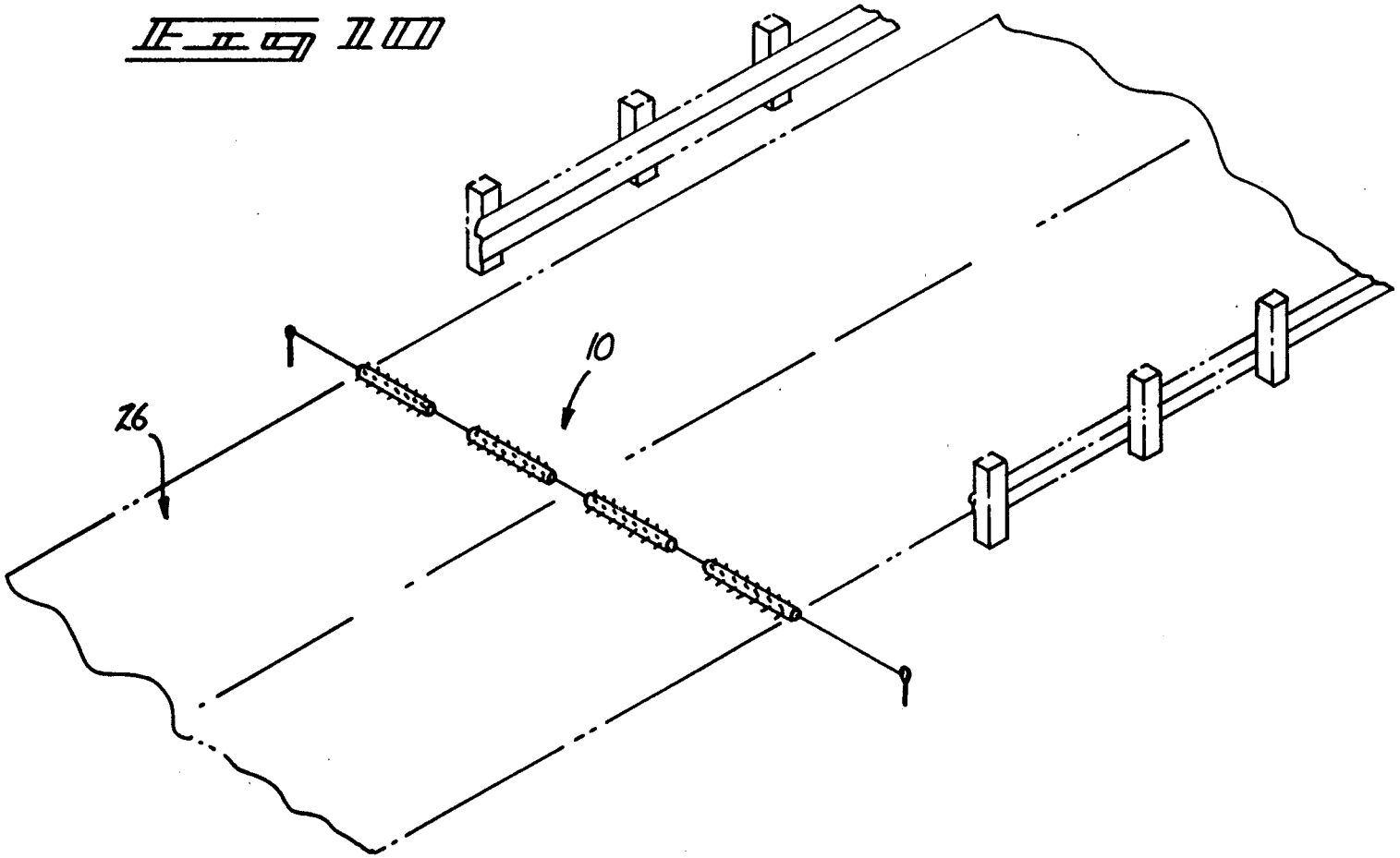

Piercer assembly 11 includes an elongate rigid tubular support member 17 formed of a predetermined diameter defined along a predetermined axis. A first and second tether line receiving bore 18 and 19 is directed through the tube member adjacent its adjacent first and second distal ends to receive a tether line thereto to permit the securing of the piercer assemblies 11 together, in a manner as illustrated in FIGS. 3 and 10.

A plurality of spaced piercing spike pairs 20 are arranged to project from the tubular support member 17 at equally spaced intervals therealong, wherein the spike pairs are arranged in a parallel relationship relative to one another. The spike pairs include respective first and second piercing spikes 21 and 22 respectively (see FIG. 6), wherein the piercing spikes are defined by a predetermined length greater than the predetermined diameter to project exteriorly of the tubular support member 17, wherein the first and second piercing spikes define an acute angle 24 of substantially one hundred twenty degrees therebetween. The first and second piercing spikes 21 and 22 are formed in parallel contiguous adjacency relative to one another orthogonally oriented relative to the predetermined axis of the tubular support member 17, and diametrically project coextensively through the tubular support member 17, in a manner as illustrated in FIG. 6. A third piercing spike 23 bisects the acute angle 24 and projects from the tubular support member 17 between an obtuse included angle between the first and second spike members 21 and 22, wherein the obtuse include angle defines substantially two hundred forty degrees. The third piercing spikes 23 are positioned medially of adjacent spike pairs 20, such as illustrated in FIG. 4, whereupon positioning of the tube support member 17 upon the spike pairs 20, the third spikes 23 project in a vertical orientation beyond the tubular support member 17 to receive and impale themselves into a tire of a vehicle in pursuit or to be stopped. Each spike member of the first, second, and third spikes 21, 22, and 23 respectively includes an enlarged spike head 25 that extends at least coplanar with or preferably somewhat beyond the exterior surface of the tubular support member 17, whereupon a tire member of a fleeing vehicle projecting itself onto any one of the spikes 21, 22, or 23 projects the spike through the tubular support 17 permitting the enlarged head 25 to provide for support by the underlying highway surface 26 as the vehicle projects onto the spike. In numerous instances, the tire to be punctured prior to the associated piercing spike being projected through the tube 17 has the mere velocity of the vehicle relative to the spike is sufficient to direct the spike into the fleeing vehicle.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tire puncturing apparatus including a plurality of piercer assemblies defining at least a first piercer assembly and a second piercer assembly, each piercer assembly including an elongate rigid tube support member defined by a predetermined diameter and a predetermined axis, wherein each tube support member includes a first distal end and a second distal end, and a first tether line receiving bore directed adjacent the first distal end through the tube support member, and a second tether line receiving bore directed adjacent the second distal end through the tube support member, and an intermediate flexible tether line securing the second distal end of the first piercer assembly and the first distal end of the second piercer assembly, and a first mounting spike tether line mounted to the first tether line receiving bore of the first piercer assembly, and a second mounting spike tether line mounted to the second tether line receiving bore of the second piercer assembly, and the first mounting spike tether line secured to a first mounting spike spaced from the first piercer assembly, and the second mounting spike tether line secured to a second mounting spike spaced from the second distal end of the second piercer assembly, and a matrix of piercing spikes projecting exteriorly of each tube support member, and at least one further piercer assembly secured between the first piercer assembly and the second piercer assembly, wherein the further piercer assembly is mounted intermediate the flexible tether line at opposed distal ends of the piercer assembly, and the matrix of piercing spikes includes a plurality of spaced piercing spike pairs, including a first piercing spike and a second piercing spike, wherein the first piercing spike and the second piercing spike of each piercing spike pair defines an acute angle of approximately 120 degrees therebetween, and the first piercing spike and the second piercing spike are orthogonally oriented relative to the predetermined axis, and the piercing spike pairs are arranged parallel relative to one another at equally spaced intervals along each tube support member, and a third piercing spike bisecting the acute included angle and projecting exteriorly of the tube support member bisecting an obtuse included angle between the first piercing spike and the second piercing spike, and the first piercing spike, the second piercing spike, and the third piercing spike are of an equal predetermined length, and the equal predetermined length is greater than the predetermined diameter, and each piercing spike of said first, second, and third piercing spikes includes an enlarged spike head positioned exteriorly of the tube support member, and each piercing spike enlarged spike head extends beyond the tube support member a predetermined second length, and each spike member includes a spike member forward terminal end projecting beyond the tube support member a third length, wherein the third length is greater than the second length.

* * * * *